US006863796B2

(12) United States Patent
Chueh et al.

(10) Patent No.: US 6,863,796 B2
(45) Date of Patent: Mar. 8, 2005

(54) METHOD FOR REDUCING CU SURFACE DEFECTS FOLLOWING CU ECP

(75) Inventors: Chia-Liang Chueh, Jia-yi (TW); Volume Chien, Taipei (TW); Shih-Ming Wang, Tainan (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 292 days.

(21) Appl. No.: 10/188,689

(22) Filed: Jul. 2, 2002

(65) Prior Publication Data

US 2004/0004004 A1 Jan. 8, 2004

(51) Int. Cl.[7] ..... C25D 5/48

(52) U.S. Cl. ..... 205/220; 134/21; 134/34; 134/41; 134/902; 438/745; 438/747

(58) Field of Search ..... 205/220; 134/21, 134/34, 41, 902; 438/745, 747

(56) References Cited

U.S. PATENT DOCUMENTS

2001/0014410 A1 * 8/2001 Mitsuhashi et al. ..... 428/607

* cited by examiner

*Primary Examiner*—Robert R. Koehler
(74) *Attorney, Agent, or Firm*—Tung & Associates

(57) ABSTRACT

A method for cleaning an electrodeposition surface following an electroplating process including providing a process surface including electro-chemically deposited metal following an electrodeposition process; and, cleaning the process surface with a sulfuric acidic cleaning solution to remove electrodeposited metal particles according to at least one of an immersion and spraying process the spraying process including simultaneously rotating the process surface.

19 Claims, 1 Drawing Sheet

METHOD FOR REDUCING CU SURFACE DEFECTS FOLLOWING CU ECP

FIELD OF THE INVENTION

This invention generally relates to copper electrocathodic plating (ECP) for semiconductor wafer electrodeposition processes and more particularly to a method for reducing surface defects including spherical copper defects remaining on the copper surface following ECP.

BACKGROUND OF THE INVENTION

Sub-micron including sub-quarter-micron multi-level metallization is one of the key technologies for the next generation of ultra large scale integration (ULSI). The multilevel interconnects that lie at the heart of this technology require planarization of interconnect features formed in high aspect ratio (opening depth: width) apertures, for example 4:1, including, vias, metal interconnect lines and other features. Reliable formation of these interconnect features is very important to the success of ULSI and to the continued effort to increase circuit density and quality on individual substrates and die.

Copper and copper alloys have become the metal of choice for filling sub-micron, high aspect ratio interconnect features on semiconductor substrates. Copper and its alloys have lower resistivity and higher electromigration resistance compared to other metals such as, for example, aluminum. These characteristics are critical for achieving higher current densities increased device speed.

As circuit densities increase, the widths of vias, contacts, metal interconnect lines, and other features, decrease to sub-micron including sub-quarter-micron dimensions, whereas the thickness of the dielectric layers, through the use low-k (low dielectric constant) materials, has remained about the same. Consequently, the aspect ratios for the features, i.e., their depth to width ratio, has increased thereby creating additional challenges in adequately filling the sub-micron features with, for example, copper metal. Many traditional deposition processes such as physical vapor deposition (PVD) and chemical vapor deposition (CVD) have difficulty filling increasingly high aspect ratio features, for example, where the aspect ratio exceeds 2:1, and particularly where it exceeds 4:1.

As a result of these process limitations, electrochemical plating (ECP) also referred to as electrodeposition, which has previously been limited to the fabrication of patterns on circuit boards, is a preferable method for filling high aspect ratio metal interconnects structures such as via openings and trench line openings on semiconductor devices. Typically, ECP uses an electrolyte including positively charged ions of deposition material, for example copper metal ions, in contact with a negatively charged substrate (cathode) having a source of electrons to deposit (plate out) the metal ions onto the charged substrate, for example, a semiconductor wafer. A thin metal layer (seed layer) is first deposited on the semiconductor wafer by PVD methods to form a liner within the high aspect ratio anisotropically etched features to provide a continuous electrical path across the surfaces. An electrical current is supplied to the seed layer whereby the semiconductor wafer surface including anisotropically etched features are electroplated with an appropriate metal, for example, copper, to conformally deposit the metal to fill the features.

In filling the via openings and trench line openings with metal, for example, copper, electroplating is a preferable method to achieve superior step coverage of sub-micron etched features. The method generally includes first depositing a barrier layer over the etched opening surfaces, such as via openings and trench line openings, depositing a metal seed layer, for example copper, over the barrier layer, and then electroplating a metal, for example copper, over the seed layer to fill the etched features to form conductive vias and trench lines. Finally, the electro deposited layer and the dielectric layers are planarized, for example, by chemical mechanical polishing (CMP), to define a conductive interconnect feature.

Metal electroplating (electrodeposition) in general is a well-known art and can be achieved by a variety of techniques. Common designs of cells for electroplating a metal on semiconductor wafers involve positioning the plating surface of the semiconductor wafer within an electrolyte solution including an anode with the electrolyte impinging perpendicularly on the plating surface. The plating surface is contacted with an electrical power source forming the cathode of the plating system such that ions in the plating solution deposit on the conductive portion of the plating surface, for example a semiconductor wafer surface.

More recent electroplating processes use a relatively high current, for example 100 to 1000 mA/cm$^2$, to improve semiconductor wafer throughput. During the electroplating process anisotropically etched features are conformally filled with for example, a copper or copper alloy metal. One problem according to prior art ECP processes is that spheroid shaped copper particles, for example as large as 0.2 microns, remain attached to the copper plating surface following the ECP process. It is believed that these spheroid particles form in part due to the high concentration of copper in the electrolyte solution needed to adequately fill the anisotropically etched features without forming voids or gaps in the feature. Although the copper spheroid particles are subsequently removed in a copper CMP process the presence of the copper particles on the surface obscures potential underlying ECP defects in optical scanning processes following the ECP process used to assure the quality of the ECP process. In addition undesirable scratching of the semiconductor surface by the copper particles during CMP occurs. As a result, semiconductor wafer quality and yield are adversely affected.

Prior art approaches to avoiding electrodeposition surface copper particles have included altering the ECP parameters including deposition waveforms and currents toward the end of the deposition process. Frequently, these approaches have introduced additional defects into the electroplated surface and have not been fully effective in eliminating the copper particles from the deposition surface.

These and other shortcomings demonstrate a need in the semiconductor processing art to develop a method for electrodeposition whereby copper particle defects remaining on the electroplating surface following an electrochemical deposition process are reduced or avoided.

It is therefore an object of the invention to provide a method for electrodeposition whereby copper particle defects remaining on the electroplating surface following an electro-chemical deposition process are reduced or avoided while overcoming other shortcomings and deficiencies in the prior art.

SUMMARY OF THE INVENTION

To achieve the foregoing and other objects, and in accordance with the purposes of the present invention, as embodied and broadly described herein, the present invention provides a method for cleaning an electrodeposition surface following an electroplating process.

In a first embodiment, the method includes providing a process surface including electro-chemically deposited metal following an electrodeposition process; and, cleaning the process surface with a sulfuric acidic cleaning solution to remove electrodeposited metal particles according to at least one of an immersion and spraying process the spraying process including simultaneously rotating the process surface.

In related embodiments, the cleaning process is carried out in-situ in an ambient controlled environment following the electrodeposition process. Further, the spraying process is carried out by spraying the sulfuric acid cleaning solution onto the process surface for a period of about 2 to about 10 seconds while simultaneously rotating the process surface at about 100 to about 300 rpm. Yet Further, the sulfuric acid cleaning solution includes about 0.15 weight percent to about 0.30 weight percent sulfuric acid in deionized water.

In another related embodiment, the sulfuric acid cleaning solution includes about 2 weight percent to about 3 weight percent hydrogen peroxide. Further, the sulfuric acid cleaning solution is applied at a temperature of from about 20 degrees Centigrade to about 30 degrees Centigrade.

These and other embodiments, aspects and features of the invention will be better understood from a detailed description of the preferred embodiments of the invention which are further described below in conjunction with the accompanying Figures.

DETAILED DESCRIPTION OF THE PREFERRED EMBODIMENTS

Figure 1:
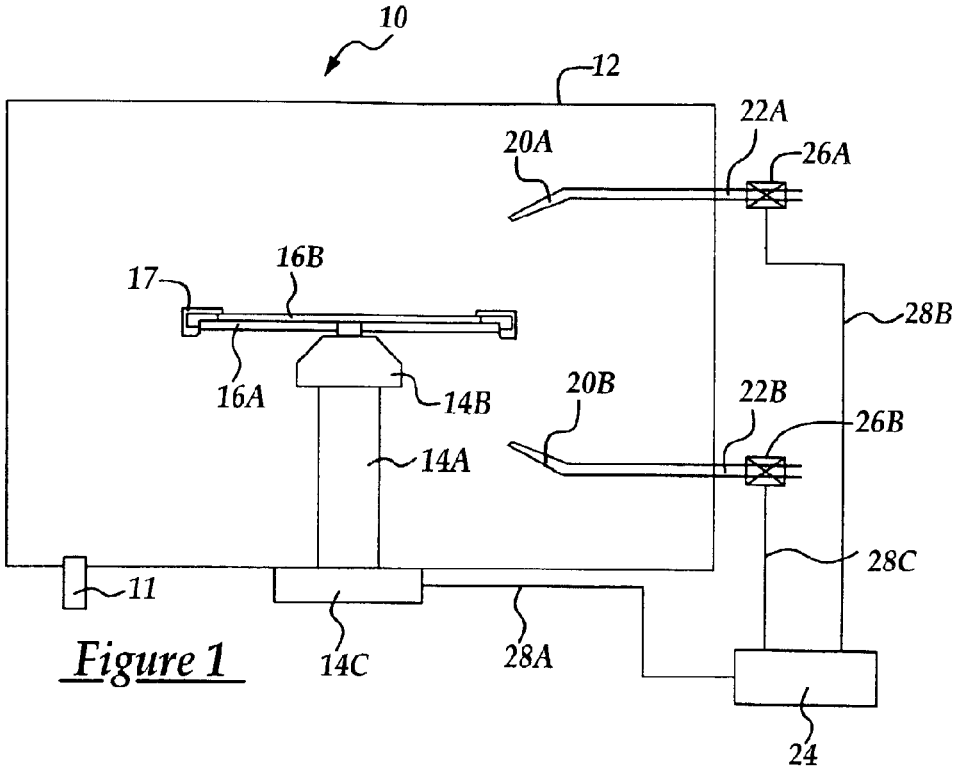
FIG. 1 is a cross sectional side view representation of an exemplary SRD module for carrying out an in-situ cleaning process according to an embodiment of the present invention.

In the method and apparatus according to the present invention, the invention is explained by reference to electrochemical plating (ECP) of copper to fill an anisotropically etched feature, for example, a dual damascene structure. It will be appreciated, however, that the method of the present invention may be advantageously applied to the electrodeposition methods including electroless deposition of any metal onto an electrode surface where it would be advantageous to remove adhering metal particles remaining on the semiconductor wafer process surface following a deposition process.

In one embodiment of the present invention, a semiconductor wafer is provided having a process surface said process surface comprising a metal layer, for example copper or copper alloy, electrodeposited from an electrolyte solution. In one embodiment, the metal layer is deposited according to at least one a conventional electroless and electro-chemical deposition method. Following electrodeposition of the metal layer, the process surface is subjected to a cleaning process with an acidic solution to remove metal particles adhering to the metal layer surface. In another embodiment, the metal layer is cleaned in-situ in a spin-rinse-dry (SRD) module following the electrodeposition process in an adjacent ECP module prior to exposure of the metal surface to an external environment. Preferably, the SRD chamber and ECP module include a controlled ambient environment.

In one embodiment, following electrodeposition, the semiconductor wafer process surface including an electrodeposited copper layer is subjected to a cleaning process using an acidic cleaning solution to remove adhering copper particles from the electroplated copper layer surface. The cleaning process preferably includes at least one of immersion and spraying. Preferably, the cleaning process includes spraying the cleaning solution onto the wafer process surface while simultaneously rotating the wafer. Preferably, the acidic cleaning solution is a sulfuric acid solution. Preferably the sulfuric acid solution includes about 0.15 wt % to about 0.30 wt %, more preferably about 0.20 wt % to about 0.25 wt. %, or most preferably, about 0.23 wt % sulfuric acid ($H_2SO_4$) in deionized water. More preferably, the sulfuric acid solution includes about 2 wt % to about 3 wt % hydrogen peroxide ($H_2O_2$), most preferably about 2.44 wt %. Preferably, the cleaning solution is applied at a temperature range of between about 20° C. and 30° C.

In another embodiment, the acidic cleaning solution is sprayed onto the process surface of a rotating process wafer, for example in an SRD chamber disposed adjacent to an ECP module. Preferably, the wafer is rotated from about 100 rpm to about 300 rpm, more preferably about 200 rpm while spraying the process surface with a stream of the acidic cleaning solution. In an exemplary embodiment the acidic cleaning solution is sprayed onto the wafer process surface from about 2 seconds to about 10 seconds, more preferably, about 4 seconds. Optionally, the backside of the wafer may be simultaneously sprayed with either the same or different cleaning solution. Alternatively, the backside may be simultaneously sprayed with rinsing solution, for example deionized water. The process surface is preferably subjected to a rinsing process by spraying deionized water onto the process surface while rotating the process wafer following the cleaning process. The wafer is then preferably dried following the rinsing process by spinning the wafer from about 500 to about 1500 rpm until dried. The SRD chamber preferably includes a controlled ambient, for example with a purged high purity (>99.99%) nitrogen atmosphere.

For example, referring to FIG. 1 is an exemplary SRD station 10 for carrying out the cleaning process according to the present invention. The SRD station 10 is for example, one module (station) in a multi-module electro-chemical processing (ECP) system. The SRD station is preferably integrated (adjacent to) with other processing stations including an ECP cell for electrodeposition of metal, preferably copper or an alloy thereof, such ECP systems known in the art. For example the ECP system is equipped with wafer cassette receiving and loading stations, orienting stations, and robotic transfer arms for automating the wafer transfer process through the ECP system. In addition, other processing stations may be optionally integrated with the ECP system to include, for example, a rapid temperature annealing station where the electrodeposited metal is treated to rapid thermal annealing (RTA) to improve the character of the deposited metal. Further, the ECP system including the SRD station preferably include a controlled ambient environment, for example, purged with high purity (e.g., >99.99%) nitrogen.

Still referring to FIG. 1, exemplary SRD station 10 includes a housing 12, including a drain 11 for draining or recycling fluid captured after being introduced to impact rotating wafer 16B through spray nozzles 20A and 20B. Wafer spindle portions e.g., 14A includes a shaft (not shown) for rotating spindle portion 14B attached to pedestal support arms e.g., 16A supporting wafer 16B. A plurality of spoke-like pedestal support arms are typically used to include open spaces between the support arms (spokes) to allow a sprayed liquid to contact the lower surface of wafer 16B. The terms 'upper' and 'lower' are used in reference to the orientation of FIG. 1.

Preferably, the process surface is oriented so that the process surface is an upper surface facing away from the pedestal support arms. The pedestal support arms e.g., 16A may include grooves for applying a vacuum suction force through wafer spindle portion 14A to aid in holding the wafer 16B in place. In addition, the pedestal support arms may include wafer holding clamps e.g., 17 that actuate with centrifugal force to hold the wafer in place, preferably contacting an edge exclusion region on the wafer upper surface.

In operation, the wafer is transferred to the SRD station 10 following a conventional ECP process depositing a layer of copper. After mounting wafer 16B, the wafer spindle portion is rotated at, for example, 100 to about 1000 rpm while an aqueous solution, for example a cleaning solution, is sprayed through one or both spray nozzles 20A, 20B supplied by solution feed lines, e.g., 22A, and 22B in communication with one or more respective solution supplies (not shown) to contact at least the process surface (e.g., upper surface) and optionally including the backside surface (e.g., lower surface) of wafer 16B. Controller 24 is in electrical communication with a variable speed rotating motor e.g., 14C rotatably attached to a rotatable shaft in wafer spindle portion 14A and flow valves 26A and 26B by respective electrical communication lines 28A, 28B, and 28C, for controllably spinning (rotating) the wafer and providing a solution flow rate to one or both of spray nozzles 20A and 20B to impact one or both of the upper (process) and lower (backside) surface of wafer 16B. It will be appreciated that a plurality of spray nozzles positioned at variable locations and distances from the wafer impact surface may be suitably used. In an exemplary spraying process the fluid pressure is about 10 to about 15 pounds per square inch (psi) with a flow rate of about 1 to about 3 gallons per minute (gpm) for a 200 mm wafer.

In other embodiments, the process wafer may be subjected to an immersion cleaning process where the wafer is dipped in the cleaning solution of the present invention of a period of from about 2 to about 10 seconds. The cleaning solution, for example, is contained in a container, preferably large enough to hold a cassette of wafers for batch processing and optionally including a megasonic ultrasound source mounted on the outside of the container to direct ultrasound waves in a parallel direction to the wafer surface, megasonic equipped cleaning containers well known in the art.

Figure 2A:
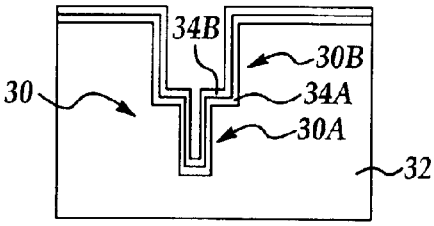
FIGS. 2A–2C are cross sectional side view representations of a portion of a semiconductor wafer showing an exemplary dual damascene structure a stages in manufacture according to an embodiment of the present invention.

In an exemplary process, for example, referring to FIG. 2A, is shown a portion of a semiconductor wafer including an anisotropically etched dual damascene structure 30 having a via portion 30A and an overlying trench line portion 30B. While there are several ways to form a dual damascene structure, one approach involves at least two photolithographic patterning and anisotropic etching steps to first form via opening e.g., 30A, followed by a similar process to form overlying trench line opening 30B. The dual damascene structure 30 is formed in an insulating layer 32, for example a low dielectric constant (e.g., <3.0) doped silicon dioxide, formed for example, by plasma enhanced CVD (PECVD) at a thickness of about 3000 Angstroms to about 10,000 Angstroms. Following anisotropic etching of the dual damascene structure 30, a barrier layer 34A of for example, TaN nitride, is conformally deposited to cover the sidewalls and bottom portion of the anisotropically etched via opening 30A and sidewalls of the trench opening 30B. The barrier layer 34A is about 100 Angstroms to about 300 Angstroms thick and serves the purpose of preventing copper diffusion into the surrounding insulating layer 32. Following barrier layer 34A deposition, a seed layer 34B of copper or copper alloy is conformally deposited over the barrier layer 34A by, for example, by PVD or CVD. The copper seed layer 34B is preferably conformably deposited to form a continuous layer. The copper seed layer 34B provides a conductive surface for a subsequent electrodeposition process whereby an electrical potential is applied to the seed layer by cathode contacts contacting, for example, the outer peripheral edges of the semiconductor wafer.

Figure 2B:
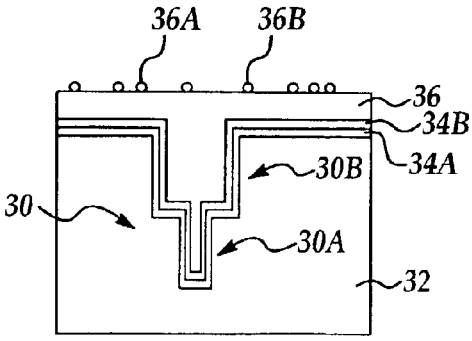
Figure 2C:
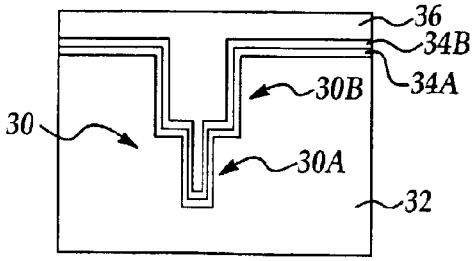

Referring to FIG. 2B, following deposition of the seed layer 34B, the semiconductor wafer is positioned in an electrolyte bath (not shown) in proximity with an anode assembly (not shown) for an electro-chemical deposition process. An electroless deposition where the copper is catalytically reduced onto the seed layer 34B may optionally precede the electro-chemical deposition process. In the electrochemical deposition process, an electrical potential is applied across the anode and the wafer process surface creating the flow of, for example, copper ions from the anode to the wafer process surface where they deposit on wafer process surface including seed layer 34B forming a copper layer 36 to fill the anisotropically etched dual damascene feature 30. The electrodeposition process may optionally include an electropolishing process following the electrodeposition process. Still referring to FIG. 2B, following the electrodeposition and optional electropolishing process, spheroidal copper particles e.g., 36*a*, 36B, for example having a diameter from about 0.1 to about 0.2 microns, remain attached on the surface of copper layer 36.

Referring again to FIG. 1, following the electrodeposition process, the process wafer is transferred to an adjacent SRD chamber 10 for in-situ cleaning with the acidic cleaning solution according to an embodiment of the present invention. As previously outlined, the wafer process surface is preferably cleaned by spraying the process wafer surface while simultaneously spinning the process wafer to dissolve and remove the spheroidal copper particles. It is believed that the copper particles are formed at the electrodeposition surface towards the end of, or following, electrodeposition process and optional electropolishing process by precipitation onto the surface from the electrolyte solution and including physical attachment to the process surface. The attached copper particles may be as large as 0.2 microns in diameter, and cause scratching in subsequent CMP processes if allowed to remain. It will be appreciated that larger or smaller metal particles may be removed as well, according to the present invention. The method according to the present invention advantageously reduces and preferably avoids the presence of adhering metal particles, for example copper, following the acidic cleaning process according to the present invention thereby reducing and preferably avoiding subsequent scratching of the semiconductor surface in a subsequent CMP process. In addition, removal of the copper particles increases the effectiveness of optical scanning tools in locating other processing defects frequently obscured by larger copper particles.

For example, an optical scanning tool, for example a KLA and COMPASS optical defect scanning tool, for automated detection of the copper metal particles and other defects was used to determine the number of spheroidal copper particles and other defects present on a copper electrodeposition surface following an exemplary electrodeposition process and prior to and following an acidic cleaning process according to one embodiment of the present invention in an SRD module. For example, the spheroidal copper particles comprise about 70 percent of the optically detected defects on a typical electrodeposited copper wafer surface. For example, before carrying out the acidic cleaning process an electro-chemically deposited copper layer making up the wafer process surface included about 5000 spheroidal copper particles attached to the electrodeposited wafer surface. Following the acid cleaning process according to an embodiment of the, optical scanning showed a decrease of the number of spheroidal copper particles attached to the electrodeposited wafer surface to about 100 thereby providing an improvement of almost 2 orders of magnitude over prior art processes.

The preferred embodiments, aspects, and features of the invention having been described, it will be apparent to those skilled in the art that numerous variations, modifications, and substitutions may be made without departing from the spirit of the invention as disclosed and further claimed below.

What is claimed is:

1. A method for cleaning an electrodeposition surface following an electroplating process comprising the steps of:

providing a process surface including electro-chemically deposited metal following an electrodeposition process; and, cleaning the process surface with a sulfuric acidic cleaning solution to remove electrodeposited metal particles according to at least one of an immersion and spraying process the spraying process including simultaneously rotating the process surface, wherein the sulfuric acid cleaning solution includes about 0.15 weight percent to about 0.30 weight percent sulfuric acid in deionized water.

2. The method of claim 1, wherein the cleaning process is carried out in-situ in an ambient controlled environment following the electrodeposition process.

3. The method of claim 1, wherein the spraying process is carried out by spraying the sulfuric acid cleaning solution onto the process surface for a period of about 2 to about 10 seconds while simultaneously rotating the process surface at about 100 to about 300 rpm.

4. The method of claim 1, wherein the sulfuric acid cleaning solution includes about 0.20 weight percent to about 0.25 weight percent sulfuric acid in deionized water.

5. The method of claim 1, wherein the sulfuric acid cleaning solution includes about 2 weight percent to about 3 weight percent hydrogen peroxide.

6. The method of claim 1, wherein the sulfuric acid cleaning solution is applied at a temperature of from about 20 degrees Centigrade to about 30 degrees Centigrade.

7. The method of claim 1, wherein the metal includes copper.

8. The method of claim 1, wherein the step of providing includes a semiconductor wafer process surface having anisotropically etched features filled with the electro-chemically deposited metal.

9. The method of claim 8, wherein the cleaning process is carried out in a semiconductor wafer spin-rinse-dry module disposed adjacent to an electrodeposition module.

10. The method of claim 9, wherein the spin-rinse-dry module includes a purged nitrogen ambient.

11. A method for in-situ cleaning a semiconductor wafer electrodeposition process surface following an electroplating process comprising the steps of:

providing a wafer process surface including electro-chemically deposited copper or alloy thereof following an electrodeposition process; and, cleaning the wafer process surface with a sulfuric acidic cleaning solution including about 0.15 weight percent to about 0.30 weight percent sulfuric acid to remove electrodeposited metal particles according to at least one of an immersion and spraying process the spraying process including simultaneously rotating the wafer process surface.

12. The method of claim 11, wherein the cleaning process is carried out in-situ in an ambient controlled environment following the electrodeposition process.

13. The method of claim 11, wherein the spraying process is carried out by spraying the sulfuric acid cleaning solution onto the process surface for a period of about 2 to about 10 seconds while simultaneously rotating the process surface at about 100 to about 300 rpm.

14. The method of claim 11, wherein the sulfuric acid cleaning solution includes about 0.20 weight percent to about 0.25 weight percent sulfuric acid in deionized water.

15. The method of claim 11, wherein the sulfuric acid cleaning solution includes about 2 weight percent to about 3 weight percent hydrogen peroxide.

16. The method of claim 11, wherein the sulfuric acid cleaning solution is applied at a temperature of from about 20 degrees Centigrade to about 30 degrees Centigrade.

17. The method of claim 11, wherein the step of providing a wafer process surface includes anisotropically etched features filled with electro-chemically deposited copper or alloy thereof.

18. The method of claim 11, wherein the cleaning process is carried out in a semiconductor wafer spin-rinse-dry module disposed adjacent to an electrodeposition module.

19. The method of claim 18, wherein the spin-rinse-dry module includes a purged nitrogen ambient.

* * * * *